US005140288A

United States Patent [19]

Grunwell

[11] Patent Number: 5,140,288

[45] Date of Patent: Aug. 18, 1992

[54] WIDE BAND TRANSMISSION LINE IMPEDANCE MATCHING TRANSFORMER

[75] Inventor: Randall L. Grunwell, Royal Palm Beach, Fla.

[73] Assignee: Motorola, Inc., Schaumburg, Ill.

[21] Appl. No.: 681,247

[22] Filed: Apr. 8, 1991

[51] Int. Cl.[5] ..... H01P 5/00

[52] U.S. Cl. ..... 333/34; 333/246

[58] Field of Search ..... 333/33, 34, 238, 246

[56] References Cited

U.S. PATENT DOCUMENTS 3,320,556 5/1967 Schneider ..... 333/238 X 3,634,789 1/1972 Stuckert ..... 333/238 X 4,881,052 11/1989 Stern et al. ..... 333/246 X 4,940,955 7/1990 Higgins, Jr. ..... 333/204

*Primary Examiner*—Paul Gensler

*Attorney, Agent, or Firm*—Robert S. Babayi

[57] ABSTRACT

An impedance matching transformer includes a dielectric having a varying thickness between opposing surfaces. A transmission conductor and a return conductor are formed on the opposing surfaces. The impedance transformation between a first terminal and a second terminal is proportional to the thickness variation of the dielectric.

7 Claims, 2 Drawing Sheets

WIDE BAND TRANSMISSION LINE IMPEDANCE MATCHING TRANSFORMER

TECHNICAL FIELD

This invention relates generally to the field of transmission lines and in particular to impedance matching transmission line structures.

BACKGROUND

In radio communication circuits, there often arises a need for impedance matching over a wide range of frequencies. Such matching may be achieved using tapered stripline techniques; however, the width of those striplines may be a problem where small size is required. Thus, a need exists for a wide-band impedance matching network with minimum size which is easily manufacturable.

SUMMARY OF THE INVENTION

Briefly, according to the invention, a transmission line structure is provided for transforming impedances between a first terminal and a second terminal. The transmission line structure includes a transmission conductor, a return conductor and a dielectric. The transmission conductor connects the first terminal to the second terminal. The dielectric has a varying thickness between the transmission conductor and the return conductor. Accordingly, the impedance transformation between the first terminal and the second terminal is substantially proportional to the thickness variations of the dielectric.

DETAILED DESCRIPTION OF THE PREFERRED EMBODIMENT

Figure 1:
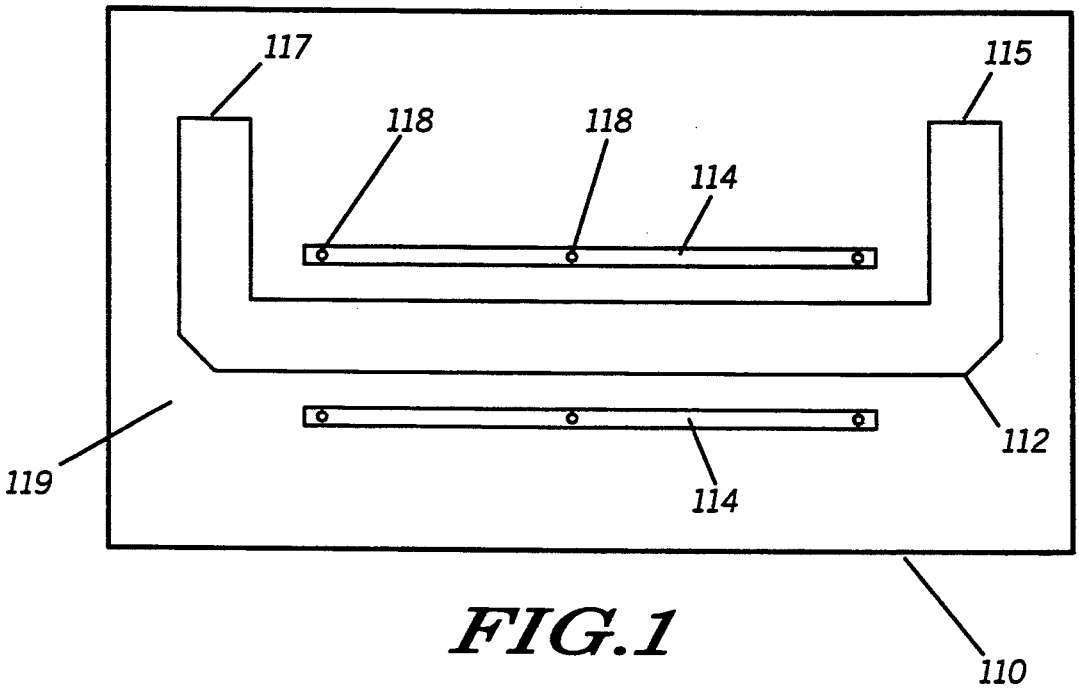
FIG. 1 is a top plan view of a circuit board included in a transmission line impedance transformer according to the present invention.

Referring to FIG. 1, a circuit board 110 for transmission line structure of the present invention has a top surface 119 which includes a circuit runner 112. The circuit runner 112 has opposing first terminal 115 and second terminal 117 which, as will be described, comprise input and output terminals of the preferred embodiment of the invention. Also disposed on the top surface 119, are conductive ground strips 114 which are in parallel along at least a portion of the circuit runner 112. The ground strips 114 include conductive thru-holes 118 which couple to a ground plane disposed on the bottom surface of the circuit board 110.

Figure 2:
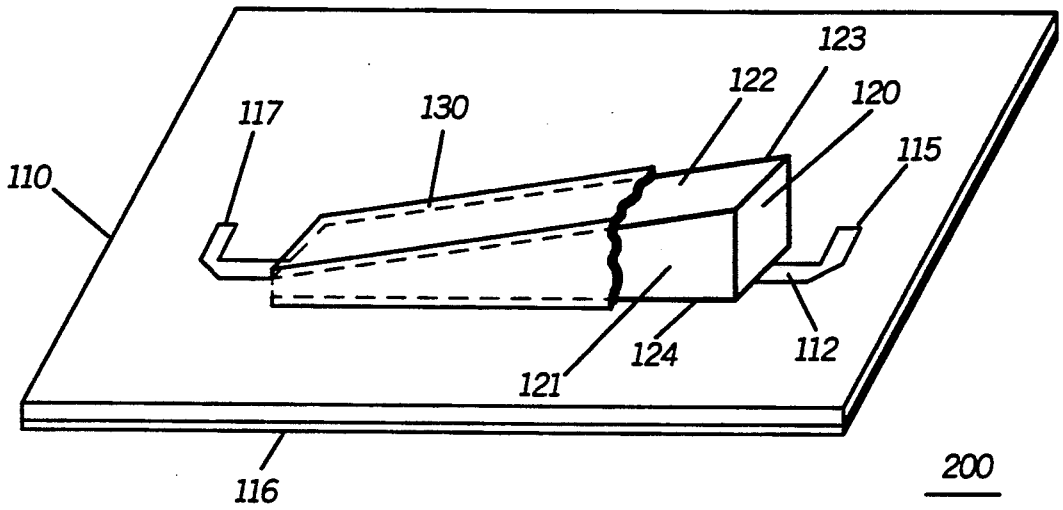
FIG. 2 is an isometric view of the transmission line impedance transformer structure of the present invention.

Referring to FIG. 2, one embodiment of a transmission line structure 200 for transforming impedances between the first terminal 115 and the second terminal 117 includes the circuit board 110 upon which a dielectric 120 is positioned. In this embodiment, the dielectric 120 has a top surface 122, a bottom surface 124, and side surfaces 121 and 123 which may include at least portions of transmission lines for the impedance transformer structure 200. A ground plane 116 is disposed on the bottom surface of the circuit board 110 and couples to the ground strips 114 (shown in FIG. 1) via the conductive thru-holes 118.

According to the present invention, the dielectric 120 has a varying thickness between a transmission conductor and a return conductor which may be disposed on the top surface 122 and the bottom surface 124. In the preferred embodiment of the invention, the thickness variation of the dielectric 120 is substantially linear, however, depending on the application non-linear thickness variations are also contemplated. In other embodiments of the present invention the dielectric 120 may have a conical shape for a coaxial transmission line structure or a flat shape for a twin lead transmission line structure. The bottom surface 124 comprises a flat surface which is positioned on the circuit board 110 and the top surface 122 comprise a uniformly diverging surface having a linear slope. In this arrangement, the impedance transformation at the terminals 115 and 117 of a transmission line structure 200 is proportional to the thickness variations of the dielectric 120.

The dielectric 120 includes transmission lines formed on its opposing surfaces. In this embodiment of the present invention, the conductive runner 112 forms at least a portion of a transmission conductor on the bottom surface 124 of the dielectric 120, and a conductive layer 130 disposed on the top surface 122 and side surfaces 121 and 123 forms a return conductor for the structure 200. The conductive layer 130 comprises a grounded layer which extends to the bottom surface 124 and, as will be described later, couples to the ground strips 114 (shown in FIG. 1). The transmission conductor and the return conductor may be formed in a variety of ways to provide the input and the output terminals. In the transmission line structure 200, the input and/or the output terminals are provided by the first terminal 115 and the second terminal 117 of the runner 112. Accordingly, impedance transformation between the first terminal 115 and the second terminal 117 of the structure 200 is provided by forming at least portions of the transmission conductor on the bottom surface 124 and at least portions of the return conductor on the diverging top surface 122 or vice versa.

Figure 3:
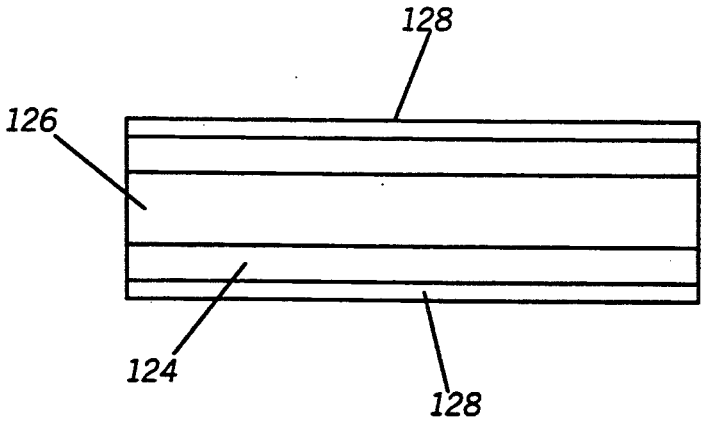
FIG. 3 is a bottom plan view of a transmission line impedance transformer of the present invention.

Referring to FIG. 3, a plan view of the bottom surface 124 of the dielectric 120 includes a conductive runner 126 disposed substantially in the center thereof. The conductive runner 126 comprises at least a portion of the transmission conductor. The conductive layer 130 (shown in FIG. 2) extends on to the bottom surface 124 to create strips 128 which couple to ground strips 114 of FIG. 1 and comprises at least a portion of the return conductor. It is also contemplated that the side surfaces 121 and 123 may only be partially metalized to connect the conductive layer 130 on the top surface 122 to the strips 128 shown in FIG. 3. The conductive runner 126 and the strips 128 of the dielectric 120 are solder bonded to the circuit runner 112 and the ground strips 114 of the circuit board 110 to provide the transmission line structure 200. It may be appreciated that the circuit runner 112 and/or the conductive runner 126 may be partially disposed on the dielectric 120 and the bottom surface 124 such that when coupled to each other, they form the transmission conductor. In this way, the bottom surface 124 of the dielectric 120 is positioned on the circuit board 110 such that the circuit portion(s) of the circuit board 110 and the conductive portion(s) of the dielectric 120 couple together to form the transmission conductor. Similarly, conductive portions may be partially disposed on the dielectric 120 and the circuit board 110 such that when soldered to each other they form the return conductor.

Figure 4:
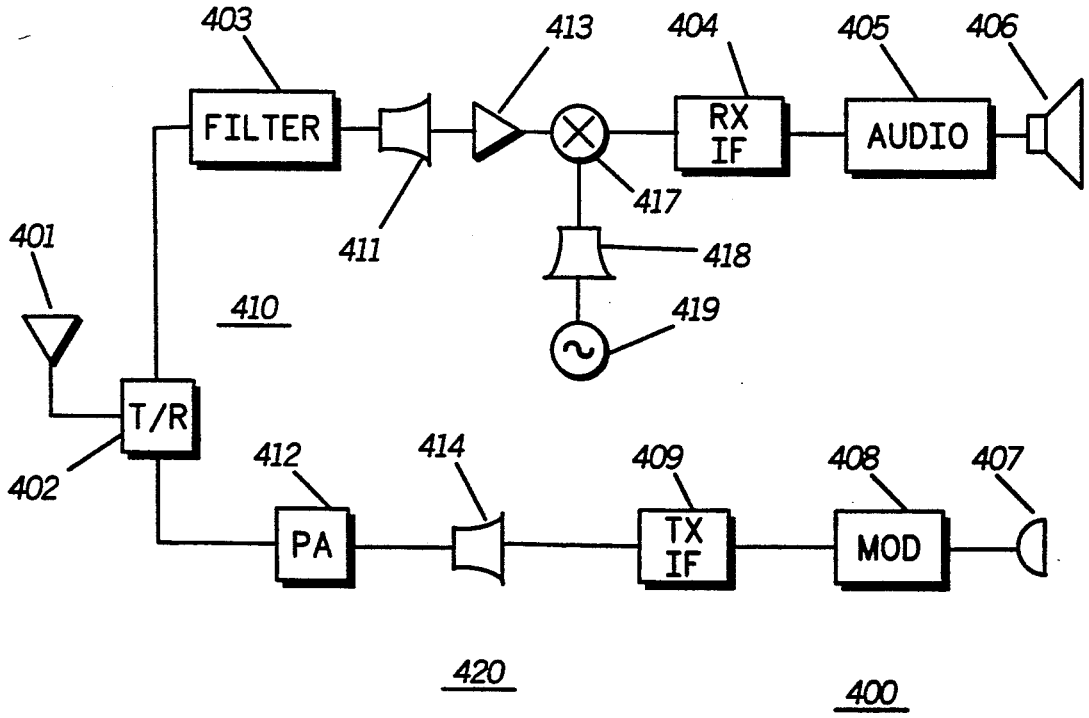
FIG. 4 is a block diagram of a radio which incorporates the transmission line impedance transformer of the present invention.

Referring to FIG. 4, the transmission line impedance transformer of the present invention is utilized in a radio 400. An example of a radio which may use the principals of the present invention comprises a Saber portable two-way radio manufactured by Motorola Inc. The radio 400 includes a receiver section 410 and a transmitter section 420 which allows it to operate in receive and transmit modes. The receiver section 410 and the transmitter section 420 comprise means for communicating, i.e. transmitting or receiving, communication signals for the radio 400.

In the receive mode, the portable radio 400 receives a communication signal via an antenna 401. A transmit/-receive (T/R) switch 402 couples the received communication signal to a filter 403 which provides the desired selectivity therefor. The output of the filter 403 is applied to an impedance transformer 411 which is constructed according to the principals of the present invention. The impedance transformer 411 provides impedance matching between the filter 411 and an amplifier 413. A mixer 417 mixes the received communication signal with the local oscillator signal from a local oscillator 419 to provide an IF signal. An impedance transformer 418 according to the present invention also provides the impedance matching between the local oscillator 419 and the mixer 417. The IF signal is applied to a well-known receiver IF section 404 which recovers the base band signal. The output of the receiver IF section 404 is applied to a well-known audio section 405 which, among other things, amplifies audio messages and presents them to a speaker 406.

In the transmit mode, audio messages are inputted via a microphone 407, the output of which is applied to a well-known modulator 408 to provide a modulating signal for a transmitter IF section 409. A transmitter power amplifier 412 amplifies the output of the transmitter IF section 409 and applies it to the antenna 401 thorugh the T/R switch 402 for transmission of the communication signal. An impedance transformer 414, according to the present invention, provides the impedance matching between the transmitter IF section 409 and the transmitter power amplifier 412. Accordingly, the impedance transformers 411, 418, and 414 comprise impedance transformer means for transforming impedance within the communication means, i.e. receiver section 410 and transmitter section 420.

It may be appreciated that the transmission conductor and the return conductor may be formed on the dielectric 120 of FIG. 2 in a number of ways. Although a stripline transmission line structure is described, it is contemplated the principals of the present invention are equally applicable to other transmission line structures such as microstrip, coaxial cable, and twin lead. In any of the foregoing structures, a dielectric medium having variable thickness between the transmission conductor and the return conductor may be constructed to transform the impedances from the first terminal to the second terminal. In one contemplated example, a coaxial transmission line structrue could include a dielectric having a conical shape having the transmission conductor through its center axis and the return conductor surrounding its outer surface. In another contemplated example, a twin lead transmission line structure could have a flat dielectric with varying thickness having the transmission conductor and the return conductor at its outer edges.

Additionally, the transmission conductors and the return conductors of the dielectric 120 may be formed to have any suitable pattern. One such pattern for the transmission and/or the return conductors is a diverging pattern on either one of the top surface 122 and the ground plane 116 as disclosed in my pending application Ser. No. 07/609,343 filed on Nov. 5, 1990, and assigned to the assignees of the present application which is incorporated herein by reference. This application describes a network for matching impedance which includes a transmission conductor and a return conductor. The impedance transformation network includes a dielectric material having metalization disposed on its opposing surfaces. The area covered by the metalization on at least one opposed surface of the dielectric material gradually diminishes from a first width to a smaller second width.

Accordingly, the transmission line structure 200 of the present invention has a substantially reduced size for providing impedance matching in a variety of communication equipment. Another advantage of the present invention is that the dielectric 120 and the conductive portions thereof may be manufactured as a piece part which may be bonded or soldered to the circuit board 110 utilizing simple automated or manual assembly processes.

What is claimed is:

1. A transmission line impedance transformer structure, comprising:

a board having disposed thereon a first conductive portion and a second conductive portion; and a dielectric including a first surface, a second surface and side surfaces, said dielectric having a varying thickness between said first surface and said second surface; wherein said first surface includes a third conductive portion and said second surface and at least a portion of at least one of said side surfaces include a fourth conductive portion; said dielectric being positioned on said board such that said first conductive portion couples to said third conductive portion to form a transmission conductor for said transmission line impedance transformer and said second conductor couples to said fourth conductor to form a return conductor for said transmission line impedance transformer.

2. The transmission line impedance transformer structure of claim 1, wherein a first and a second terminal is provided at opposing ends of said transmission conductor.

3. The transmission line impedance transformer structure of claim 2, wherein said first and said second terminals are positioned on said board.

4. The transmission line impedance transformer structure of claim 1, wherein said circuit board includes a ground plane being coupled to the return conductor.

5. A radio, comprising:

communication means for communicating communication signals;

a transmission line impedance transformer means for transforming impedance within said communication means from a first terminal to a second terminal, including:

a circuit board;

a transmission conductor connecting said first terminal to said second terminal being at least partially disposed on the circuit board, a return conductor being at least partially disposed on the circuit board, and a dielectric including a first surface, a second surface and side surfaces, said dielectric having a varying thickness between said first surface and said second surface and positioned on the circuit board such that at least a portion of said transmission conductor is positioned on said first surface and at least a portion of said return conductor is positioned on said second surface and said side surfaces.

6. The radio of claim 5, wherein said dielectric thickness variation is substantially linear.

7. The radio of claim 5, wherein said circuit board includes a ground plane for said transmission line impedance transformer means.

* * * * *